United States Patent [19]

Kusano et al.

[11] 4,408,379

[45] Oct. 11, 1983

[54] METHOD OF PRODUCING AN ALUMINUM WHEEL RIM

[75] Inventors: Takuo Kusano, Mishima; Kouichi Masuda, Fuji; Masatoshi Namba, Tokyo, all of Japan

[73] Assignee: Nippon Light Metal Co., Ltd., Tokyo, Japan

[21] Appl. No.: 245,639

[22] Filed: Mar. 19, 1981

[30] Foreign Application Priority Data

Mar. 19, 1980 [JP] Japan ..... 55-034013
Dec. 5, 1980 [JP] Japan ..... 55-170866

[51] Int. Cl.[3] ..... B21K 1/38; B21B 15/00
[52] U.S. Cl. ..... 29/159.1; 72/68
[58] Field of Search ..... 29/159.1; 72/68, 84, 72/367, 370, 105

[56] References Cited

U.S. PATENT DOCUMENTS 2,291,393 7/1942 LeJeune ..... 29/159.1

FOREIGN PATENT DOCUMENTS 770685 3/1957 United Kingdom ..... 29/159.1

*Primary Examiner*—Nicholas P. Godici
*Assistant Examiner*—Peter Martine
*Attorney, Agent, or Firm*—McAulay, Fields, Fisher, Goldstein & Nissen

[57] ABSTRACT

The method for producing an aluminum wheel rim comprises axially pressing a thin walled cylindrical aluminum or aluminum alloy material under the action of compressive stress acting thereon through tapered portions of a die and a punch cooperating therewith in a press machine so that the diameter of the material is enlarged so as to form the required configuration of the rim, while the wall thickness of the material is increased at positions where compressive stress is applied through the tapered portions of the die and the punch thereby increasing the mechanical strength of the material at positions where otherwise weakening tends to occur due to the thinning of the wall thickness of the material by the roll working thereof. In order to successfully carry out the method, it is preferred to select the ratio H/D of the height H of the material with respect to the inner diameter D thereof to be equal to or less than 1.5, the ratio t/D of the wall thickness t of the material with respect to the inner diameter D to be in the range of 0.006 to 0.06 and the mean deformation resistance or mean flow stress of the material to be in the range of 10 to 25 kg/mm$^2$, while the inclination angle of the tapered portions of the die and the punch is set to be in the range of 10° to 65°.

3 Claims, 30 Drawing Figures

10

11
10

12
11
10

13
11
10

13
11
10
14
15
16

13
11
10
14
15
17

19a
13
19
11
10
14
15
18
17
18a

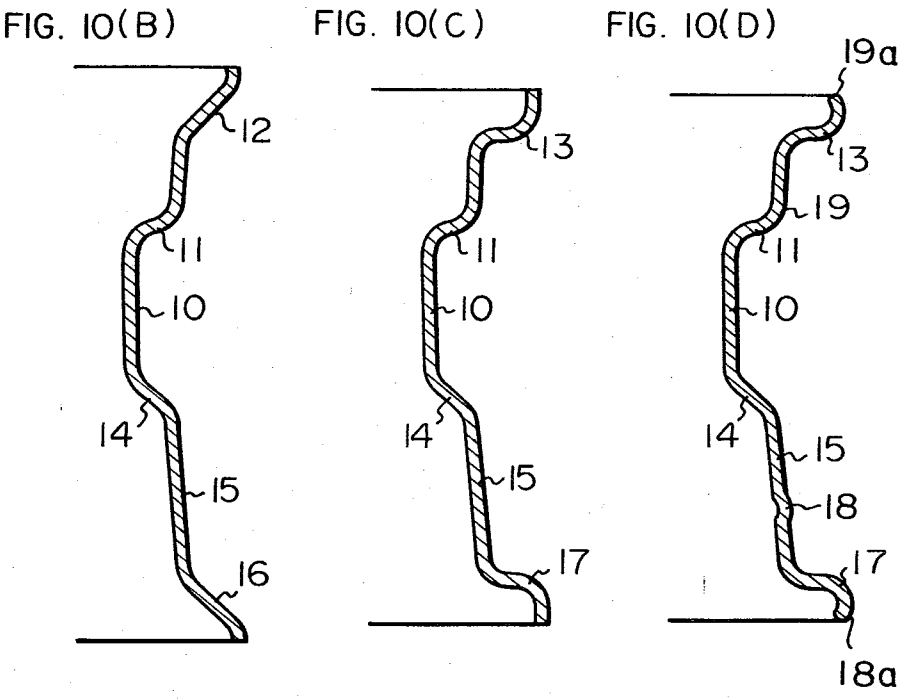
FIG. 10(D)
FIG. 10(C)
FIG. 10(B)
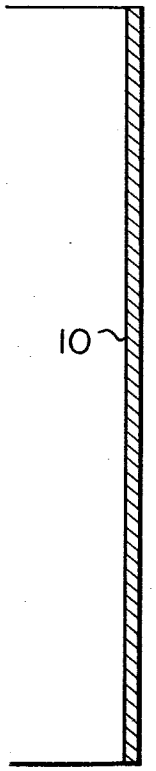
FIG. 10(A)

METHOD OF PRODUCING AN ALUMINUM WHEEL RIM

BACKGROUND OF THE INVENTION

The present invention relates to an aluminum wheel rim and to a method for producing said rim and, more particularly, to an aluminum wheel rim and to a method for producing same wherein the aluminum wheel rim has a light weight and a good appearance as well as an appropriate mechanical strength distribution in its entirety without any difficult process and failure.

An aluminum wheel for use in a vehicle which is made of aluminum or aluminum alloy has advantages in that it has a light weight and a unique glossy appearance without requiring any particular metal plating process, while the production thereof requires less energy, so that it has recently been developed widely.

The prior art aluminum wheel has been produced in general by a casting process using sand or metallic molds or by a die casting process. Therefore, the metallic structure of such an aluminum wheel is basically of a casting structure. Thus, it is difficult to obtain sufficient mechanical strength required for such a wheel, and, therefore, the wall thickness of the wheel must necessarily be increased to achieve the required mechanical strength thereby resulting in an increased weight of the wheel at the sacrifice of the merit of an aluminum wheel characterized by the light weight thereof.

In order to avoid the above described disadvantages of the aluminum wheel, it has been proposed to divide the wheel into two or three parts such as into a rim portion and a disc portion to be assembled therewith later so that a rolling process can be applied to some parts of the wheel such as the rim portion requiring an increased mechanical strength. Thus, the rim portion has been produced by a roll working process from a rolled plate which had been bent into a cylindrical form with end edges joined together. However, when the rim portion is produced by the roll working process, it can not be avoided that thinned portions tend to appear in the thus produced rim portion at the very positions where an increased mechanical strength is required. Thus, the thickness of the material or rolled plate from which such a rim portion is to be produced by the roll working process must necessarily be increased so as to insure the required mechanical strength in such thinned portions of the rolled rim portion. It also causes an increase in weight of the rim portion at the sacrifice of the merit of the aluminum wheel described above and disadvantages in that it requires increased energy for producing the rim portion thereby forfeiting economy in the production of the aluminum wheel.

The present invention aims at avoiding the above described disadvantages of the prior art aluminum wheel and the method for producing same.

SUMMARY OF THE INVENTION

It is an object of the present invention to provide an aluminum wheel rim which avoids the above described disadvantages of the prior art aluminum wheel rim and a method for producing said rim which is relatively easily carried out without any difficult processes and failures and yet makes it possible to produce such an aluminum wheel rim having a minimum weight and superior appearance.

It is another object of the present invention to provide a method of the kind described above which can be carried out by a minimum number of working processes.

The method in accordance with the present invention is characterized in that a relatively thin walled, cylindrical extruded aluminum or aluminum alloy material is used in making the rim of an aluminum wheel which is pressed axially under the action of compressive stress acting through tapered portions of the die and the punch in a pressing machine onto the material so as to widen the diameter of the material for forming the required configuration of the rim while portions in the material are thickened by virtue of the compressive stress acting thereon through the tapered portions of the die and the punch so that the deterioration in the mechanical strength, which otherwise occurs due to thinning of the material during the working, can positively be avoided.

Preferred embodiments of the present invention will be described hereinbelow with reference to the accompanying drawings illustrating the same.

BRIEF DESCRIPTION OF THE DRAWINGS

FIG. 10 is a view similar to FIG. 3 but showing the successive steps of the press working and roll working in accordance with the second embodiment of the present invention;

DETAILED DESCRIPTION OF THE PREFERRED EMBODIMENTS

Figure 1:
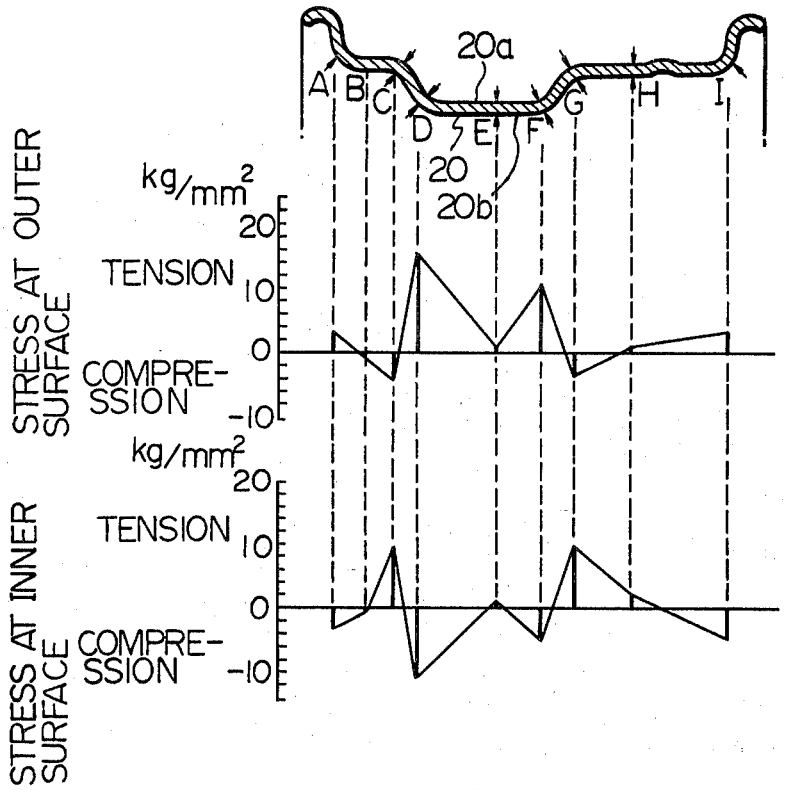
FIG. 1 is a diagram showing the section of a rim of an aluminum wheel for a vehicle and the distribution of the stresses in various portions of the rim at the outer and the inner surface thereof.

With reference to FIG. 1, the stresses occurring at various portions in the outer surface 20*a* and the inner surface 20*b* of a rim 20 of an aluminum wheel consisting of the rim 20 and a disc portion (not shown) to be assembled therewith are shown under the conditions of the standard tire pressure of 4.0 kg/cm$^2$ and the load of 1100 kg. As shown, the tensile stress on the outer surface at the point D is largest amounting to 15 kg/mm$^2$ while the compressive stress on the inner surface at the point D is the largest amounting to 11 kg/mm$^2$. Also at the point F, the tensile stress on the outer surface is high amounting to 11 kg/mm$^2$ and the compressive stress on the inner surface is fairly high amounting to 5 kg/mm$^2$, the tensile stresses on the inner surface at the points C and G being also high as shown. It is clear from FIG. 1 that severely stressed conditions take place at bent portions in cross-section of the rim subjected to severe working such as conventional roll working process.

Figure 2:
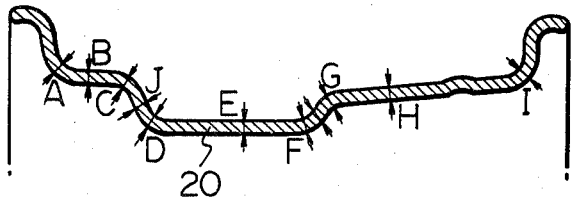
FIG. 2 is a sectional view showing the section of a rim in which the wall thicknesses thereof at various portions are denoted by reference symbols A, B, C,—I and J.

For example, however, an aluminum wheel rim produced by the conventional roll working process from a cylindrical aluminum material of JIS A5052 having the wall thickness of 4 mm and the inner diameter of 300 mm has the following wall thickness distribution along its cross-section with reference to FIG. 2:

| Point of Measurement | A | B | C | D | E | F | G | H | I |
|---|---|---|---|---|---|---|---|---|---|
| Wall Thickness (mm) | 3.5 | 4.0 | 3.7 | 3.5 | 4.3 | 3.7 | 3.6 | 4.0 | 3.5 |

From the above, the wall thickness at the points D,A and I is reduced by about 12% from the original thickness, and the wall thickness at the points F and C is also reduced by about 7.5%, these being the very portions where increased mechanical strength is required as is clear from FIG. 1, while the wall thickness at the point E where no increased mechanical strength is required is thickened by about 7.5%.

In view of the above, it is clearly understood that the wall thickness of the rim produced by the conventional working process is quite inconveniently thinned at the very portions thereof where the increased mechanical strength is required in order to resist against the severely stressed conditions, while the wall thickness is increased where no increased mechanical strength is required. This means that excessively thick aluminum material must be used in the production of the rim in the conventional working process in order to resist the severely stressed conditions in the thinned portions of the rim caused by the conventional working process thereby increasing the weight of the rim at the sacrifice of the merit obtainable from the aluminum wheel rim characterized by the light weight thereof while larger capacity machines are required for working thicker material for compensating for the insufficient strength resulting from the thinned portions.

The present invention solves the above described disadvantages of the prior art in a very simple and effective measure as described hereinbelow.

FIG. 3 shows the successive steps (A)-(G) of working the thin walled cylindrical aluminum element 10 by successively using several die-punch sets and a forming roll set shown in FIGS. 4-9.

Figures 3A, 3B, 3C, 3D, 3E, 3F, 3G:
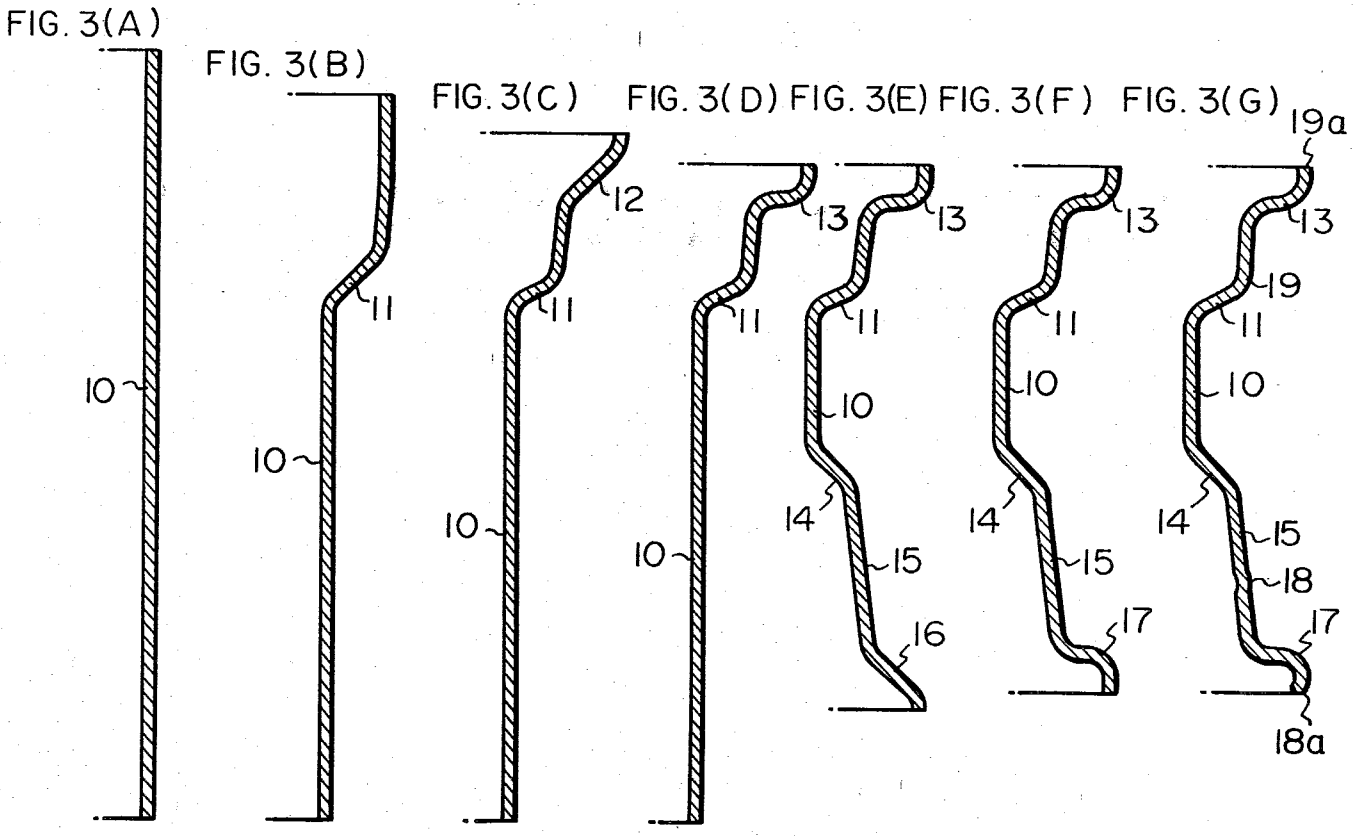
FIG. 3 is a view showing the cross sections of the rim produced by the present invention in the respective successive steps of the press working and roll working.
Figure 4A:
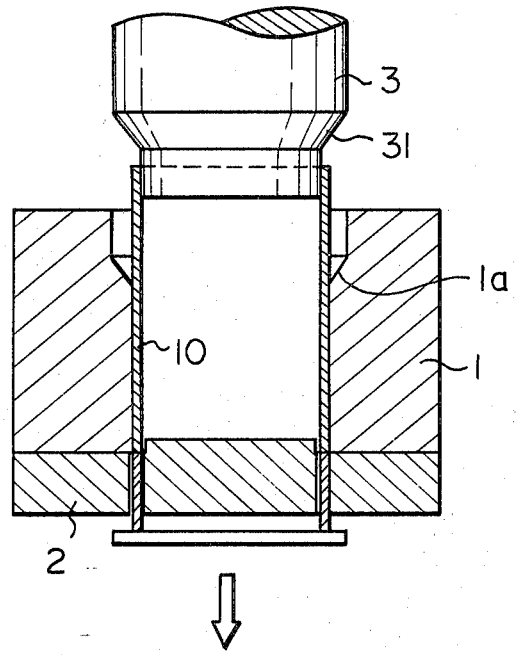
FIGS. 4 to 9 are sectional views showing the manner in which the raw material is worked successively so as to form the rim, respectively.
Figure 4B:
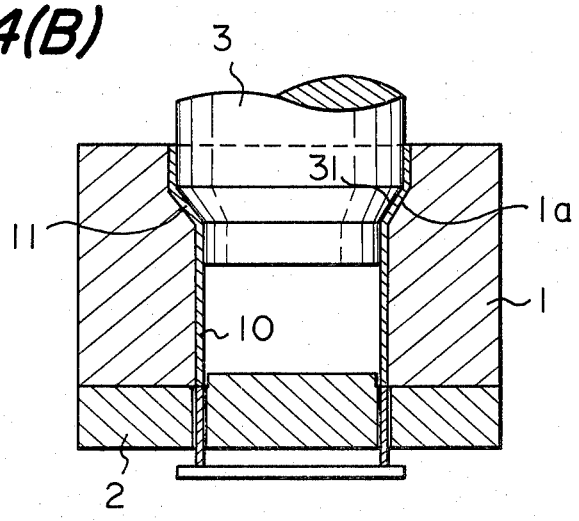

Referring to FIG. 4, the aluminum element 10 is set in a side die 1 having a tapered portion 1*a* at the upper portion of its bore and a lower die 2 with the lower end of the element supported by a support member. Then, an upper punch 3 having a tapered portion 31 corresponding to the tapered portion 1*a* of the die 1 is urged in the interior of the element 10 set in the die 1 so that the upper portion of the element above the point D is enlarged in its diameter by the horizontal component of the compression force applied through the cooperating tapered portions 1*a* and 31. At this very moment, the portion 11 of the element 10 subjected to the compression force through the tapered portions 1*a* and 31 is thickened by virtue of the flow of the mass of the material of the element 10 caused by the relative movement of the tapered portions 1*a* and 31, entraining the mass of the material sticking to or frictionally contacting the tapered portions 1*a* and 31 without causing any buckling action of the element 10 (FIG. 3(B)).

This thickening of the wall portion 11 subjected to the compression force through the cooperating tapered portions 1*a* and 31 is the characteristic feature of the present invention.

Figure 5A:
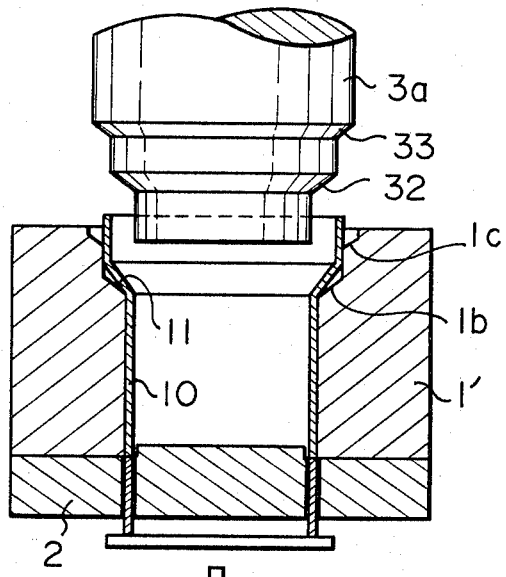
Figure 5B:
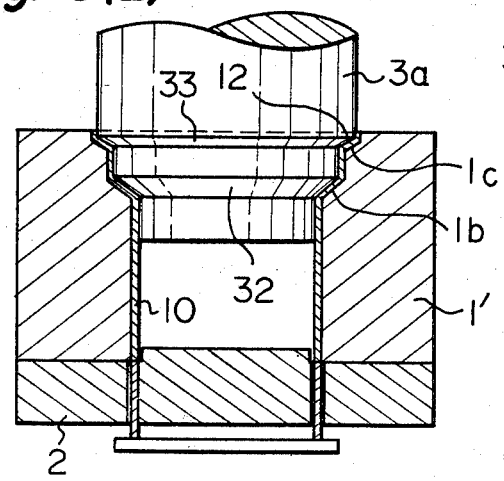
Figure 6:
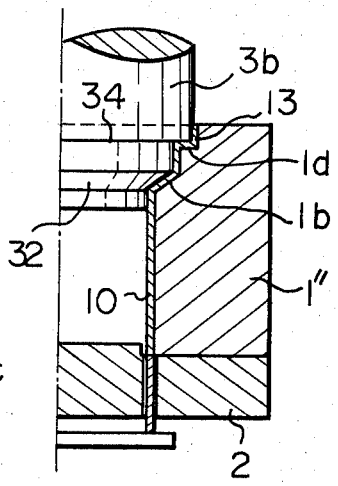

After the press working of the element 10 has been completed by using the die 1 and the punch 3 shown in FIG. 4 so that the thickened and enlarged diameter portion 11 has been formed, the element 10 is worked by using an upper punch 3*a* having two tapered portions 32, 33 and a side die 1' having two tapered portions 1*b* and 1*c* corresponding to those 32, 33, respectively, as shown in FIG. 5 so that the wall portion including the portions 11 and 12 (FIG. 3(C)) is formed. In this step of working, the thickness of the portion 11 which has been thickened in the previous working is not substantially deteriorated insofar as the proper thickening of the wall has been achieved in the previous working.

In a similar manner, the thus worked material is successively worked by using a die 1'' having a rectangularly stepped portion 1*d* as well as the tapered portion 1*b* and a punch 3*b* having a rectangular shoulder portion 34 cooperating with the stepped portion 1*d* as well as the tapered portion 32 so as to form a rectangularly bent portion 13 (FIG. 3(D)). Thus, the configuration of one side of the rim is formed except the rounding off of the end edge 19*a* and the formation of a hump 19 (FIG. 3(G)) which are to be worked later together with the rounding off of the opposite end edge 18*a* and the formation of a hump 18 (FIG. 3(G)) after the configuration of the other side of the rim is formed in the manner described below.

Figure 7A:
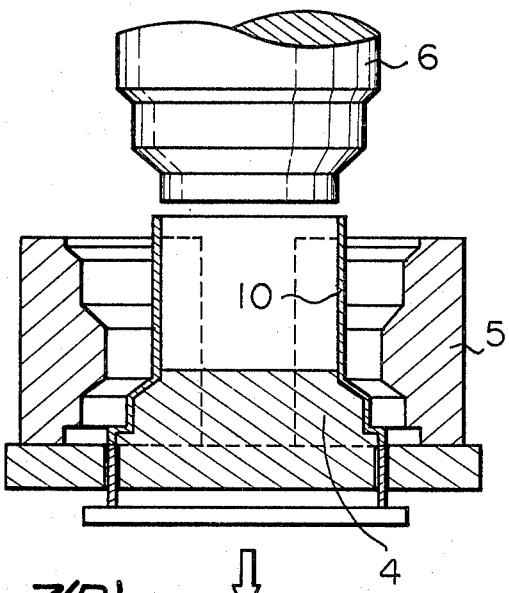
Figure 7B:
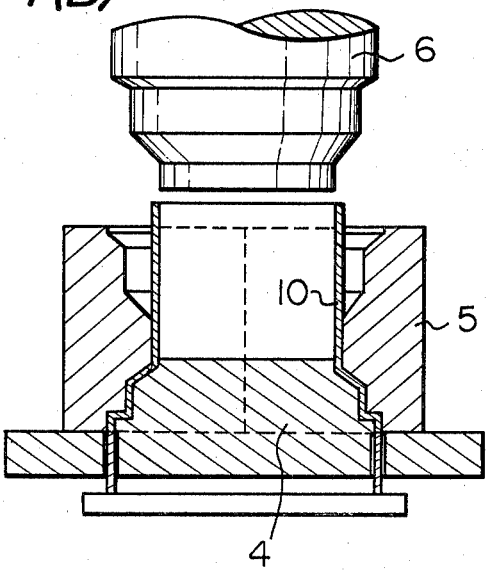
Figure 8A:
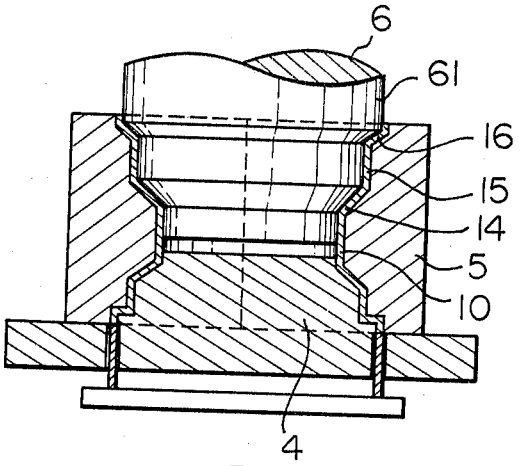

The working of the other side of the rim is effected by using a die 5 and a punch 6 as shown in FIGS. 7 and 8(A). In this case, the die 5 is of the split type and the element 10 is turned upside down and the previously shaped side of the rim is supported from the inside thereof by a lower support member 4 and the die 5 is applied to the outside of the material 10 and clamped tightly together by a holder (not shown). Then, the punch 6 is operated so as to form the enlarged diameter portions 14, 15 and 16 (FIG. 3(E)).

In this case, the thickening of the wall thickness at the portions 14, 15, 16 is positively achieved in the same manner as that described previously with reference to FIG. 4.

Figure 8B:
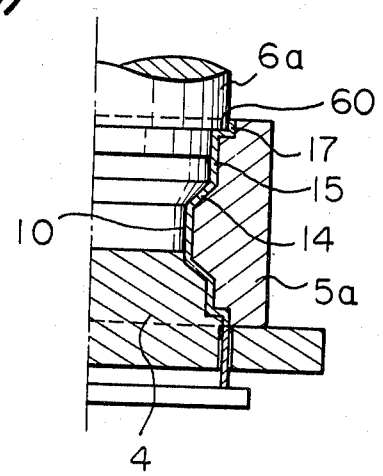

Then, the formation of the rectangularly bent portion 17 (FIG. 3(F)) is carried out by using a die 5*a* and a punch 6*a* having a rectangular shoulder portion 60 shown in FIG. 8(B).

Figure 9A:
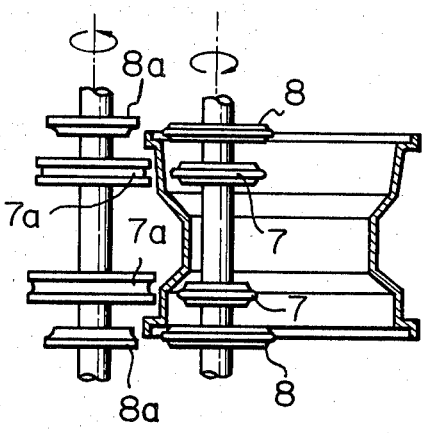
Figure 9B:
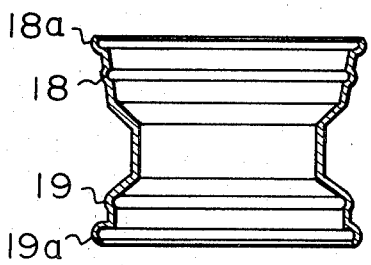

The final step of forming the rim is rounding off of the end edges 19*a*, 18*a* for preventing damage to the tire applied thereon and the formation of the humps 19, 18 in FIG. 3(G) which are carried out by roll working rolls 7,7 8,8 and 7*a*,7*a*, 8*a*,8*a* as shown in FIG. 9. This process is conventional and is not described here in detail.

The results of the tests of thickening of the wall thickness of the rim achieved in accordance with the present invention will be described hereinafter.

A number of elements 10 were prepared from materials having compositions JIS A5052, 6062, 6063, 5154, 5056 and the inner diameter of the element was set to be 300 mm and 340 mm. The ratio H/D of the height or the length H of the material 10 with respect to the inner diameter D was selected to be 1.3, 1.5 and 1.7 while the ratio t/D of the wall thickness t of the element 10 with respect to the inner diameter D was selected to be 0.004, 0.006, 0.01, 0.06 and 0.07.

The inclination angle $\theta$ of the tapered portions 1a and 31 of the die 1 and the punch 3 shown in FIG. 4 was selected to be 7°, 10°, 30°, 45°, 50°, 55°, 60°, 65° and 70°.

Test data of thickening of the wall thickness and the generation of the buckling at the point D (FIG. 1) using the material 10 having the composition JIS A5052 (mean flow stress or mean deformation resistance 15 kg/mm²) are shown in the following Table I.

TABLE I

| Angle of Taper ($\theta$°) | Inner Dia. (D mm) | Ratio (H/D) | Ratio (t/D) | Wall Thickness | Buckling |
|---|---|---|---|---|---|
| 7 | 300 | 1.5 | 0.01 | No increase | No |
| 10 | " | " | " | Increase | " |
| 30 | " | " | " | " | " |
| 45 | " | " | " | " | " |
| 50 | " | " | " | " | " |
| 55 | " | " | " | " | " |
| 60 | " | " | " | " | " |
| 65 | " | " | " | Slight increase | " |
| 70 | " | " | " | No increase | " |
| 45 | " | 1.7 | " | " | Yes |
| 45 | 340 | 1.3 | 0.006 | Increase | No |
| 30 | " | " | 0.004 | " | Yes |
| 30 | " | " | 0.06 | " | No |
| 30 | " | " | 0.07 | " | Slightly Yes |

Substantially the same results were obtained using elements 10 from materials having other compositions of various mean deformation resistances such as 8, 10, 25 and 29 kg/mm².

From the above results, it is seen that the thickening of the wall thickness at the bent portion described above appears by making the inclination angle of the tapered portion of the punch equal to or greater than 10°, and the rate of thickening is made greater as the inclination angle of the taper increases up to about 45°, but the rate of thickening decreases as the inclination angle of the taper exceeds 48° to 50° and the thickening will not appear as the inclination angle increases beyond 65°. As to the relationship between the wall thickness t and the inner diameter D of the element, it is seen that the ratio t/D is preferably set in the range of 0.006 to 0.06 and, when the ratio t/D exceeds 0.06, buckling at the bent portion will take place, while buckling will also appear as the ratio t/D decreases less than 0.006. As to the ratio H/D of the height H with respect to the inner diameter D, it is preferable to set the ratio H/D to be equal to or less than 1.5. When the ratio H/D exceeds 1.7, thickening of the wall thickness will not appear, but buckling at the bent portion will take place.

As to the means flow stress or the mean deformation resistance of the material, it is preferred to select it to be within the range of 10 to 25 kg/mm².

By selecting the inclination angle of the tapered portion of the punch to be 45° and the inner diameter D to be 340 mm, while the ratio H/D is set to b 1.3, the thickening if the wall thickness and the occurrence of the buckling were observed in the tests using the material having various mean deformation resistance as shown in the following Table II.

TABLE II

| Composition of Material | Mean Deformation Resistance (kg/mm²) | Thickening of Wall Thickness | Buckling |
|---|---|---|---|
| JIS A5052 | 15 | Increase | No |
| JIS 6061 | 10 | " | No |
| JIS 6063 | 8 | " | Yes |
| JIS 5154 | 25 | " | No |
| JIS 5056 | 29 | " | Crack |

In summarizing the above results, it can be said that proper thickening of the wall thickness without generating buckling of the material for forming the aluminum wheel rim in accordance with the present invention is achieved by selecting the inclination angle of the tapered portion of the punch 31 to be in the range of 10° to 65°, and the ratio H/D to be equal to or less than 1.5, the ratio t/D to be in the range of 0.006 to 0.06 while the mean deformation resistance of the material 10 is selected to be in the range of 10 to 25 kg/mm².

The results of the thickening of the wall thickness of the aluminum wheel rim produced in accordance with the present invention by using an element 10 having the composition JIS A5052 (mean deformation resistance 15 kg/mm²) and the wall thickness of 4 mm and the inner diameter of 300 mm are shown in the following Table III, wherein the data of the wall thickness of the rim produced by the conventional process from the material of the same composition and the size are given for the purpose of comparison.

TABLE III

| | Wall Thickness (mm) | | | | | | | | |
|---|---|---|---|---|---|---|---|---|---|
| Point of Measurement | A | B | C | D | E | F | G | H | I |
| Prior Art | 3.5 | 4.0 | 3.7 | 3.5 | 4.3 | 3.7 | 3.6 | 4.0 | 3.5 |
| Present Invention | 3.87 | 4.12 | 4.38 | 4.38 | 4.0 | 4.38 | 4.38 | 4.12 | 3.99 |

Remarks:
The points of measurement A–I are shown in FIG. 2.

From the above table, it is clearly seen that the present invention provides thickened wall portions in the aluminum wheel rim produced in accordance with the present invention where increased mechanical strength is required for bearing against the load so that the material for forming the rim can be made lighter in weight in the order of about 20% in comparison with that required for producing the rim by the conventional process thereby permitting the advantages of the aluminum wheel rim characterized by the light weight thereof to be fully achieved and the cost of the material to be considerably saved, while the capacity of the machines for producing the rim in accordance with the present invention as well as the consumption of energy for the production can be considerably reduced.

The above described method utilizes relatively large number of sets of dies and punches for successively effecting various steps of deformations of the material by the press working.

FIGS. 10 to 13 show a modified method for producing an aluminum wheel rim in accordance with the further feature of the present invention, wherein the number of sets of dies and punches are considerably reduced so as to save the investment of production equipment and the time required for the production.

Figure 11A:
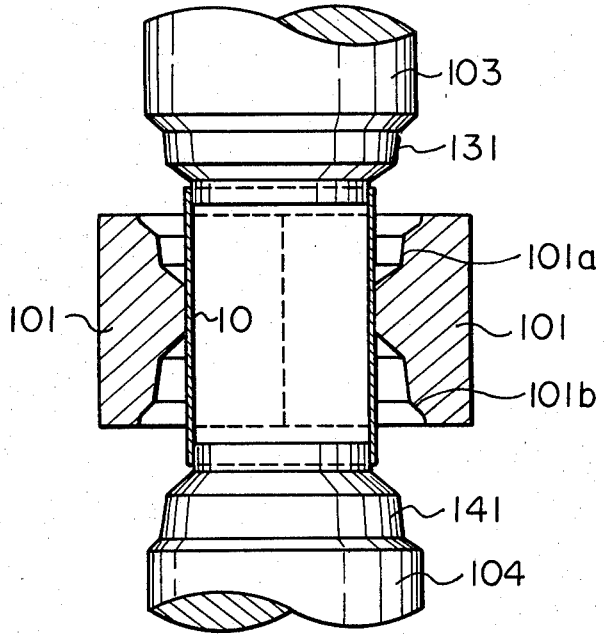
FIGS. 11 and 12 are cross sectional views showing the respective steps of press working of the material according to FIG. 10.
Figure 11B:
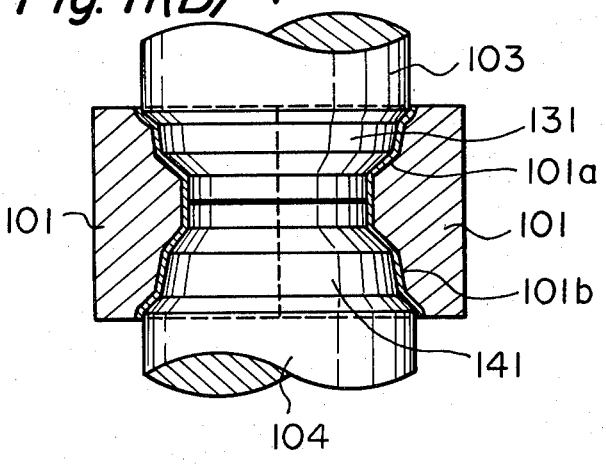
Figure 12A:
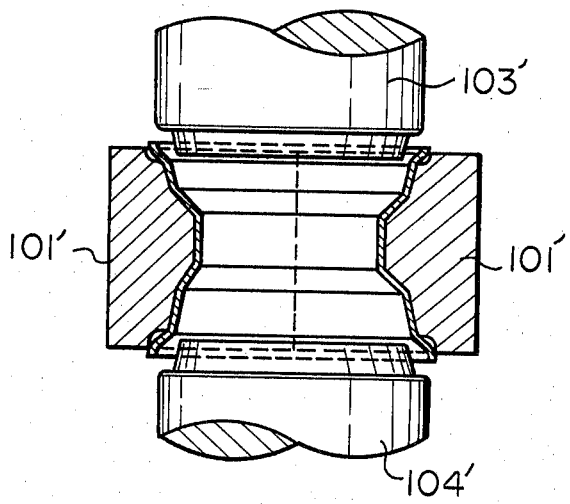
Figure 12B:
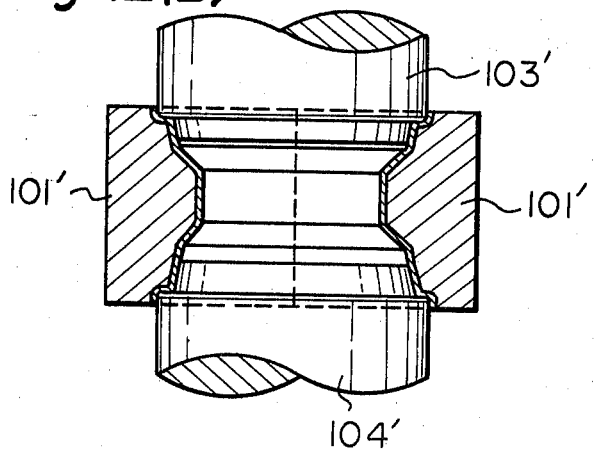

FIG. 10 shows the steps of deformation of an element 10 for forming the rim in accordance with the modified method of the present invention. As seen in this figure, both sides of the rim are simultaneously worked in three steps, i.e., the first step for forming the portions 11, 12, 14, 15 and 16 (FIG. 10(B)) simultaneously by using a die 101 of the split type having a pair of tapered portions 101*a*, and 101*b*, and a pair of punches 103 and 104 each having a tapered portion 131 and 141 as shown in FIG. 11, the second step for forming the portions 13 and 17 (FIG. 10(C)) by using a die 101' of the split type and a pair of punches 103' and 104' as shown in FIG. 12 and the final step of roll working the rounded off portions at both end edges 19*a*, 18*a* and a pair of hump 19, 18 by using the roll working rolls 7,7, 8,8 and 7*a*,7*a* and 8*a*,8*a* as shown in FIG. 9.

The function is similar to that described previously in connection with FIGS. 3–9, except that the both sides of the rim are simultaneously worked successively, wherein the thickening of the wall thickness at the portions where increased mechanical strength is required is positively achieved in the same manner as described previously.

Figure 13:
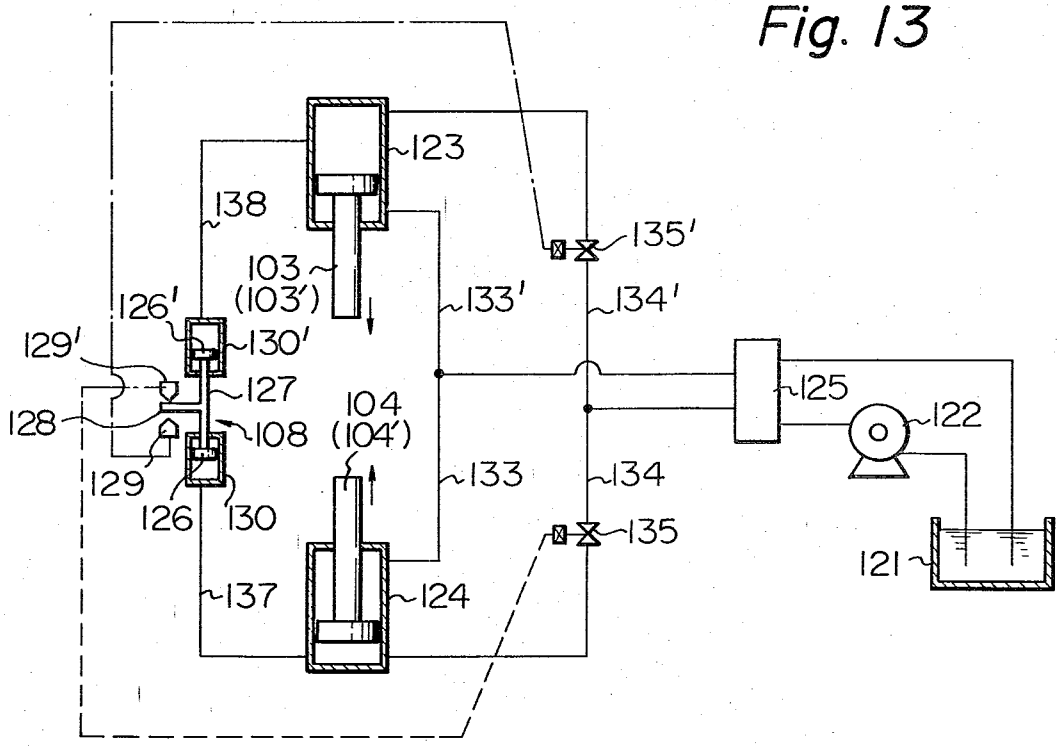
FIG. 13 is a diagram showing the hydraulic control circuit for balancing the upper and lower punch for producing the rim in accordance with the working steps shown in FIGS. 11 and 12.

In order to insure the simultaneous working of both sides of the rim under the balanced condition of the punching force of the upper and lower punches, an hydraulic or oil actuated control device 108 is provided as shown in FIG. 13.

As shown in the drawing, the upper and the lower punch 103, 104 (or 103', 104') are driven by hydraulic or oil actuated cylinders 123, 124, respectively, and the pressurized fluid or oil supplied from a reservoir 121 is applied to the respective cylinders 123, 124 by pump 122 through a solenoid valve 125 and two pairs of pipes 134, 134' and 133, 133' and returned to the reservoir 121. As shown electromagnetic valves 135, 135' are provided in the pipes 134, 134', respectively, for feeding the pressurized fluid to actuate the punches 104, 103 (104', 103'). A pipe 137 communicates the pressure chamber of the cylinder 124 with the pressure chamber of a pilot cylinder 130 of the control device 108 in which a piston 126 is slidably provided so as to be actuated by the pressurized fluid in the pressure chamber of the cylinder 124. In the similar manner, a pipe 138 provides communication between the pressure chamber of the cylinder 123 and the pressure chamber of a pilot cylinder 130' of the control device 108 in which a piston 126' is slidably provided so as to be actuated by the pressurized fluid in the pressure chamber of the cylinder 123.

The piston 126 and the piston 126' are integrally connected by a common connecting rod 127 which is provided at its intermediate portion with a laterally extending lug or projection 128. A pair of limit switches 129 and 129' are provided at the opposite sides of the lug 128 in spaced relationship from each other so that either one of the limit switches 129, 129' can be actuated by the lug 128 when the rod 127 and, hence, the lug 128 move upwardly or downwardly in FIG. 13 by the imbalanced actuation of the cylinders 123 and 124 and, hence, the pilot cylinders 130' and 130.

The switch 129 is electrically connected to the electromagnetic valve 135' provided in the pipe 134'0 leading to the cylinder 123, while the switch 129' is electrically connected to the electromagnetic valve 135 in the pipe 134 leading to the cylinder 124.

Thus, the pressure variation in the cylinders 123, 124 is differentially sensed by the control device 108, wherein either of the switches 129, 129' is actuated upon occurence of imbalanced conditions so as to operate either one of the electromagnetic valves 135, 135' so that the punching forces of the punches 103, 104 (103', 104') are balanced.

Table IV shows the thickening of the wall thickness of the rim as produced in accordance with the method shown in FIGS. 10–13 starting from the material of JIS A5052 having a mean deformation resistance of 15 kg/mm$^2$ and having a wall thickness of 4 mm and an inner diameter of 300 mm.

TABLE IV

| Point of Measurement | A | B | C | D | E | F | G | H | I |
|---|---|---|---|---|---|---|---|---|---|
| Wall Thickness (mm) | 3.90 | 4.10 | 4.15 | 4.40 | 4.0 | 4.34 | 4.37 | 4.15 | 3.90 |

In comparing the above table with Table III, it is apparent that the method shown in FIGS. 10–13 is far superior to the prior art method and rather preferable to the method shown in FIGS. 3–9 in order to produce an aluminum wheel rim of lighter weight and superior mechanical strength and to save the cost of the material as well as the investment in production equipment.

We claim:

1. A method for producing an aluminum wheel rim from a thin walled cylindrical element of an aluminum or aluminum alloy material comprising axially pressing the element under the action of compressive stress acting thereon through tapered portions of a die and a punch cooperating therewith in a press machine so that the diameter of the element is enlarged so as to form the required configuration of the rim, while the wall thickness of the element is increased at positions where compressive stress is applied through the tapered portions of the die and the punch thereby increasing the mechanical strength of the element at positions where otherwise weakening tends to occur due to thinning of the wall thickness of the material during roll working thereof, the ratio H/D of the height H of the element with respect to the inner diameter D thereof being set to be equal to or less than 1.5 and the ratio t/D of the wall thickness t of the element with respect to the inner diameter D being set to be in the range of 0.006 to 0.06, while the mean deformation resistance of the material is set to be in the range of 10 to 25 kg/mm$^2$ and the inclination angle of the tapered portions of the die and the punch is set to be in the range of 10° to 65°.

2. The method as set forth in claim 1, comprising axially pressing the element simultaneously at both sides thereof under the action of compressive stress acting thereon through the tapered portions of a longitudinally split die and a pair of punches cooperating therewith at the respective sides of the element.

3. Method for producing an aluminum wheel rim from a thin walled cylindrical aluminum or aluminum alloy material comprising axially pressing the material simultaneously at both sides thereof under the action of compressive stress acting thereon through tapered portions of a longitudinally split die and a pair of punches cooperating therewith at the respective sides of the material in a press machine so that the diameter of the material is enlarged to form the required configuration of the rim, while the wall thickness of the material is increased at positions where compressive stress is applied through the tapered portions of the die and the punch thereby increases the mechanical strength of the material at positions where otherwise weakening tends to occur due to the thinning of the wall thickness of the material during the roll working thereof; and the ratio H/D of the height H of the material with respect to the inner diameter D thereof is equal to or less than 1.5 and the ratio t/D of the wall thickness t of the material with respect to inner diameter D is set to be in the range of 0.006 to 0.06, while the mean deformation resistance of the material is set to be in the range of 10 to 25 kg/mm$^2$ and the inclination angle of the tapered portions of the die and the punch is set to be in the range of 10° to 65°.

* * * * *